US008144109B2

(12) United States Patent
Koh

(10) Patent No.: US 8,144,109 B2
(45) Date of Patent: Mar. 27, 2012

(54) INVERTER FOR LIGHT SOURCE DEVICE, LIGHT SOURCE DEVICE, DISPLAY DEVICE AND LIQUID CRYSTAL DISPLAY DEVICE

(75) Inventor: Hideki Koh, Tsu (JP)

(73) Assignee: Sharp Kabushiki Kaisha, Osaka (JP)

( * ) Notice: Subject to any disclaimer, the term of this patent is extended or adjusted under 35 U.S.C. 154(b) by 578 days.

(21) Appl. No.: 12/090,674

(22) PCT Filed: Aug. 17, 2006

(86) PCT No.: PCT/JP2006/316163

§ 371 (c)(1),
(2), (4) Date: Apr. 18, 2008

(87) PCT Pub. No.: WO2007/060772

PCT Pub. Date: May 31, 2007

(65) Prior Publication Data

US 2009/0262279 A1 Oct. 22, 2009

(30) Foreign Application Priority Data

Nov. 28, 2005 (JP) ..... 2005-341593

(51) Int. Cl.
*G09G 3/36* (2006.01)

(52) U.S. Cl. ..... 345/102; 315/171; 315/272; 315/387

(58) Field of Classification Search ..... 345/102; 315/171, 200 R–208, 219, 253–255, 260, 315/265–266, 272, 387
See application file for complete search history.

(56) References Cited

U.S. PATENT DOCUMENTS

| | | | | |
|---|---|---|---|---|
| 6,661,181 | B2 | 12/2003 | Shin | |
| 7,023,145 | B2 * | 4/2006 | Hwang et al. | 315/276 |
| 7,489,087 | B2 * | 2/2009 | Suzuki et al. | 315/224 |
| 2004/0004596 | A1 * | 1/2004 | Kang et al. | 345/102 |

FOREIGN PATENT DOCUMENTS

| | | | |
|---|---|---|---|
| JP | 3083447 | U | 1/2002 |
| WO | WO 2006/051630 | A1 * | 5/2006 |

OTHER PUBLICATIONS

Official Communication for PCT Application No. PCT/JP2006/316163; mailed Oct. 3, 2006.

* cited by examiner

*Primary Examiner* — Jimmy H Nguyen
(74) *Attorney, Agent, or Firm* — Keating & Bennett, LLP

(57) ABSTRACT

In a light source inverter rectifier circuits are respectively connected to a CCFL in a substantially U-shaped lamp and a CCFL in a substantially U-shaped lamp, and the outputs from the rectifier circuits are fed to a stabilization circuit. Thus, the stabilization circuit monitors an average of currents flowing through the substantially U-shaped lamps. This makes it possible to make uniform the currents flowing through the substantially U-shaped lamps.

12 Claims, 9 Drawing Sheets

INVERTER FOR LIGHT SOURCE DEVICE, LIGHT SOURCE DEVICE, DISPLAY DEVICE AND LIQUID CRYSTAL DISPLAY DEVICE

BACKGROUND OF THE INVENTION

1. Field of the Invention

The present invention relates to an inverter for a light source device (hereinafter, "light source inverter") that drives a cold cathode fluorescent lamp (CCFL) serving as a light source, and more particularly to a light source inverter that drives a light source in which two CCFLs are arranged substantially in the shape of the letter U. The present invention also relates to a light source device including such a light source inverter and CCFL, and to a display device and a liquid crystal display device including such a light source device.

2. Description of the Related Art

Since display devices such as television sets and monitors are required to be compact today, and even small-sized electrical devices such as mobile telephones and PDAs (personal digital assistants) are provided with display devices, thin display devices such as liquid crystal display devices are desired. Liquid crystal display devices are provided with a liquid crystal panel containing liquid crystal in which the orientation of its molecules can be changed by the application of a voltage. Light is modulated by employing variations in optical characteristics such as optical rotary power corresponding to the change in the molecular orientation of the liquid crystal in the liquid crystal panel. Thus, light corresponding in intensity to the brightness of each pixel is transmitted to allow a display operation; the liquid crystal panel in itself, however, emits no light. For this reason, a light source is required that illuminates the liquid crystal panel. Hence, two types of liquid crystal display devices are available: transmissive liquid crystal display devices, where a backlight is employed as a light source; and reflective liquid crystal display devices, where an outside light source is employed.

Since transmissive liquid crystal display devices have higher color saturation than reflective liquid crystal display devices, and thus provide easy-to-view images even in poorly-lit indoor conditions, they are becoming increasingly used. Disadvantageously, however, transmissive liquid crystal display devices consume a large amount of electric power, and their displayed images are not sufficiently bright in well-lit outdoor conditions. For this reason, semi-transmissive liquid crystal display devices become available today in which a backlight is employed in a poorly-lit area, whereas outside light is employed in a well-lit area. There are two types of transmissive liquid crystal display devices: direct-type transmissive liquid crystal display devices incorporating a backlight in which a plurality of CCFLs are disposed immediately behind a liquid crystal panel; and edge-light type transmissive liquid crystal display devices incorporating a backlight that passes the light emitted from CCFLs disposed at the edge of the device via the flat surface of a light guide plate.

In transmissive liquid crystal display devices incorporating such backlights, a substantially U-shaped lamp composed of two CCFLs arranged side by side is used as a light source for the backlights. The CCFLs are driven so that the substantially U-shaped lamp emits light. Since an alternating-current power supply is required for driving the CCFLs, the transmissive liquid crystal display device incorporating the backlight is provided with a light source inverter for generating an alternating-current voltage.

As an example of the configuration of a light source inverter, a light source device that includes two substantially U-shaped lamps, each having two CCFLs is shown in FIG. 10. The light source inverter shown in FIG. 10 includes: transformers 102*a* and 102*b* stepping up alternating-current voltages to apply these stepped-up voltages to CCFLs 101*a* and 101*b*, respectively, in a substantially U-shaped lamp 101*x*; transformers 102*c* and 102*d* stepping up alternating-current voltages to apply these stepped-up voltages to CCFLs 101*c* and 101*d*, respectively, in a substantially U-shaped lamp 101*y*; rectifier circuits 103*a* and 103*b* connected to the secondary sides of the transformers 102*a* and 102*b*, respectively, to perform half-wave rectification; a stabilization circuit 104 receiving the currents that are half-wave rectified by the rectifier circuits 103*a* and 103*b*; a switching circuit 105*a* connected to the primary sides of the transformers 102*a* and 102*b* to perform power control on the primary sides of the transformers 102*a* and 102*b*; a switching circuit 105*b* connected to the primary sides of the transformers 102*c* and 102*d* to perform power control on the primary sides of the transformers 102*c* and 102*d*; and a control circuit 106 that sets switching frequencies for the switching circuits 105*a* and 105*b* according to an output from the stabilization circuit 104.

In the light source inverter of the configuration shown in FIG. 10, the currents received from the rectifier circuits 103*a* and 103*b* connected to the low-voltage sides of the transformers 102*a* and 102*b* connected to the substantially U-shaped lamp 101*x* are smoothed and compared with the reference value by the stabilization circuit 104. Based on this comparison result, the control circuit 106 operates the switching circuits 105*a* and 105*b* so as to stabilize the voltages outputted from the secondary sides of the transformers 102*a* to 102*d* connected to the substantially U-shaped lamps 101*x* and 101*y*. In other words, the switching circuits 105*a* and 105*b* each perform feedback operations based on the currents that are fed from the transformers 102*a* and 102*b* and are then monitored by the stabilization circuit 104.

In the configuration shown in FIG. 10, however, when the CCFLs 101*a* to 101*d* in the substantially U-shaped lamps 101*x* and 101*y* vary in impedance, or when their impedances vary due to uneven thermal distribution within the backlight, there is a possibility that a required voltage is not supplied to the substantially U-shaped lamp 101*y*. Thus, variations in the impedance of the CCFLs 101*a* to 101*d* in the substantially U-shaped lamps 101*x* and 101*y* may cause variations in the brightness of the substantially U-shaped lamps 101*x* and 101*y*.

In particular, when a direct-type backlight is used in a liquid crystal display device having a large screen, a large number of substantially U-shaped lamps are arranged as shown in FIG. 11A. In this case, for example, when n substantially U-shaped lamps 101 are arranged, and the temperatures of the substantially U-shaped lamps 101 within a backlight decrease from the first row to the nth row as shown in FIG. 11B, the impedance of the substantially U-shaped lamp 101 in the first row more greatly differs from that of the substantially U-shaped lamp 101 in the nth row. Thus, for example, even if the rectifier circuits and the stabilization circuit are connected to the CCFLs 101*a* to 101*b* in the substantially U-shaped lamp 101 in the first row, and each of the voltages applied to the substantially U-shaped lamps 101 in the first to nth rows is attempted to be stabilized based on the current flowing through the substantially U-shaped lamp 101 in the first row, the currents flowing through the substantially U-shaped lamps 101 in the first to nth rows actually differ from each other.

In contrast, a backlight assembly is proposed in which a plurality of substantially U-shaped lamps are arranged, a stabilization circuit is connected to each of the substantially U-shaped lamps and feedback control is individually performed for each of the substantially U-shaped lamps (see patent document 1). When the configuration of the backlight assembly disclosed in patent document 1 is applied to that shown in FIG. 10, in the same manner that the rectifier circuits 103*a* and 103*b* and the stabilization circuit 104 are provided, two rectifier circuits connected to transformers 102*c* and 102*d* and the stabilization circuit that receives the half-wave rectified currents from the rectifier circuits are provided and a control circuit that controls the switching circuit 105*b* according to the output from the stabilization circuit is provided separately from the control circuit 106.

Like the backlight assembly in patent document 1, substantially U-shaped lamps, transformers and stabilization circuits are connected based on the connection relationship shown in FIG. 10. In this way, it is possible to eliminate differences between the currents generated when CCFLs are connected in parallel to one transformer and the complexity of interconnection caused by connecting a stabilization circuit to the CCFLs connected via a transformer in series. In the backlight assembly in patent document 1, a stabilization circuit is provided for each of substantially U-shaped lamps. Thus, unlike the case where the stabilization circuit is provided for only one substantially U-shaped lamp as shown in FIG. 10, since the backlight assembly in patent document 1 is provided with the stabilization circuit for each of the substantially U-shaped lamps, it is possible to control substantially U-shaped lamps individually, and also to eliminate differences between the currents flowing through the substantially U-shaped lamps.

Patent document 1: JP-A-2002-231034

SUMMARY OF THE INVENTION

In a case where a stabilization circuit is provided for each of substantially U-shaped lamps as in the backlight assembly disclosed in patent document 1, however, when a large number of substantially U-shaped lamps are provided as in the case of FIG. 11A, it is necessary to provide stabilization circuits according to the number of the substantially U-shaped lamps. Thus, in this case, the size of the device is increased as compared with the case where the stabilization circuit is provided for only one substantially U-shaped lamp as shown in FIG. 10. On the other hand, since devices are required to be compact today, it is preferable that the size of the device be reduced by the use of one stabilization circuit. As described above, however, when a plurality of substantially U-shaped lamps are incorporated as in the case of FIG. 11A, the currents flowing through the substantially U-shaped lamps greatly differ from each other. This results in large variations in brightness, thus affecting unevenness in the display of a liquid crystal display device.

An object of the present invention is to provide a light source inverter and a light source device incorporating such a light source inverter that makes uniform currents flowing through individual substantially U-shaped lamps with a stabilization circuit that receives currents from lamps in different substantially U-shaped lamps. Another object of the present invention is to provide a display device and a liquid crystal display device, each incorporating a light source device that makes uniform currents flowing through individual substantially U-shaped lamps.

To achieve the above objects, according to one aspect of the present invention, a light source inverter includes: a plurality of transformers applying alternating-current voltages to a plurality of light-emitting lamps, respectively; a control section controlling electric power induced at secondary sides of the plurality of transformers; and a current detection section detecting currents flowing through two lamps, located apart from each other, of the plurality of transformers. Here, the control section controls the electric power induced at the secondary sides of the plurality of transformers based on the currents detected by the current detection section.

According to another aspect of the invention, a light source device is characterized in that it is provided with the light source inverter and a plurality of lamps driven by the light source inverter to emit light. Here, a direct-type backlight may be incorporated in which a plurality of lamps are arranged perpendicular to a direction where light is emitted; an edge-light type backlight may be incorporated that includes a light guide plate that directs light emitted from a plurality of lamps in a predetermined direction. In the edge-light type backlight, the lamps may be arranged on both sides of the light guide plate or the lamps may be arranged on one side of the light guide plate.

According to still another aspect of the invention, a display device is characterized in that it is provided with the light source device and a display section achieving display by receiving light from the light source device.

According to yet another aspect of the invention, a liquid crystal display device is characterized in that it is provided with the light source device serving as a backlight and a liquid crystal panel achieving display by receiving, from behind, light from the light source device, varying orientation of liquid crystal and thus changing a light transmittance of liquid crystal.

According to the present invention, it is possible to reduce variations in current due to variations in impedance by controlling the power supplied to the secondary sides of transformers based on currents following through two lamps located apart from each other. Thus, it is possible to make uniform the brightness of light emitted from each lamp serving as a light source. This helps reduce unevenness of light emitted from the light source device. Since transformers are all controlled by the detection of currents flowing through the two lamps, it is possible to reduce the size of a device as compared with the case where each transformer is individually controlled by the detection of currents flowing through all the lamps.

Other features, elements, processes, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
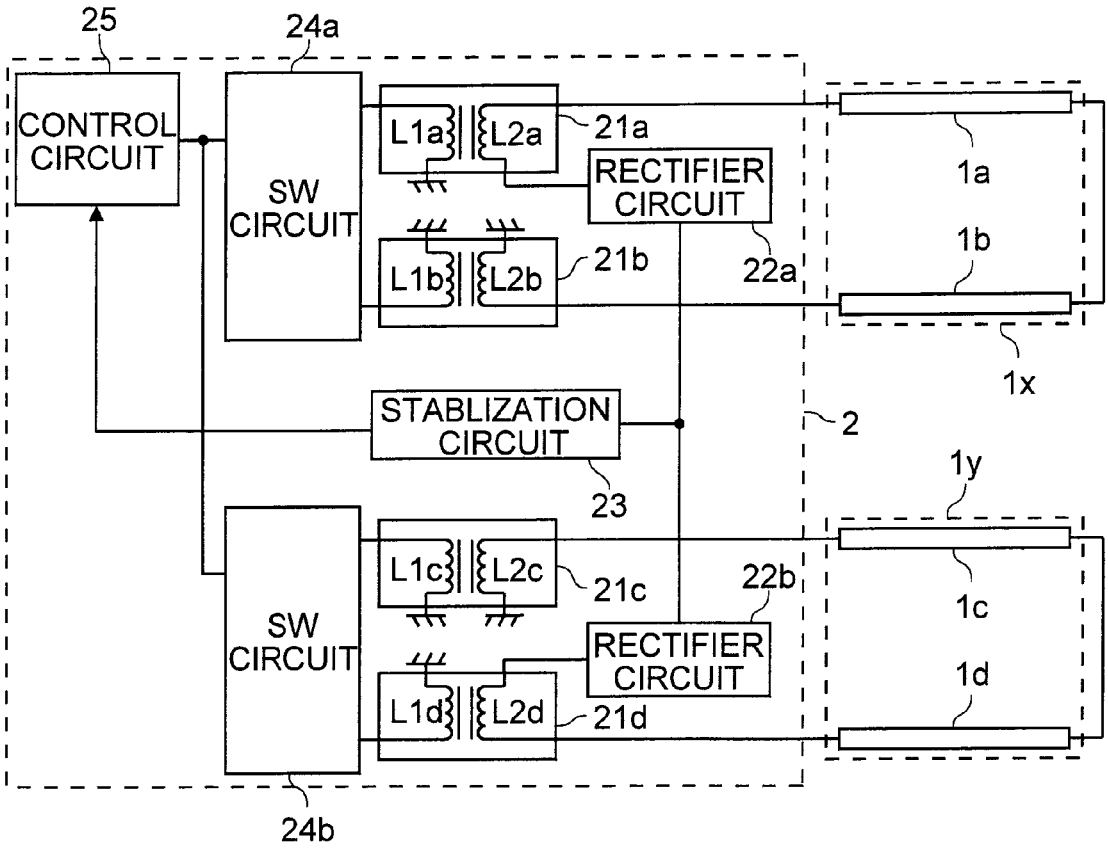
FIG. 1 is a block diagram showing the configuration of a light source device according to an embodiment of the present invention.

An embodiment of the present invention will be described with reference to the accompanying drawings. FIG. 1 is a block diagram schematically showing the configuration of a light source device serving as the backlight of this embodiment. FIG. 1 shows the light source device including two substantially U-shaped lamps.

The light source device shown in FIG. 1 is provided with two substantially U-shaped lamps 1*x* and 1*y*, and a light source inverter 2 for applying alternating-current voltages to the substantially U-shaped lamps 1*x* and 1*y*. The substantially U-shaped lamp 1*x* is composed of two CCFLs 1*a* and 1*b* connected in series; the substantially U-shaped lamp 1*y* is composed of two CCFLs 1*c* and 1*d* connected in series The light source inverter 2 includes: transformers 21*a* to 21*d* producing alternating-current voltages that are applied to the CCFLs 1*a* to 1*d*, respectively; rectifier circuits 22*a* and 22*b* connected to the secondary sides of the transformers 21*a* and 21*d*; a stabilization circuit 23 receiving a voltage signal obtained by combining voltage signals that are half-wave rectified by the rectifier circuits 22*a* and 22*b*; a switching circuit 24*a* connected to the primary sides of the transformers 21*a* and 21*b* to perform power control on the primary sides of the transformers 21*a* and 21*b*; a switching circuit 24*b* connected to the primary sides of the transformers 21*a* and 21*b* to perform power control on the primary sides of the transformers 21*a* and 21*b*; and a control circuit 25 controlling the switching operations of the switching circuits 24*a* and 24*b* according to the output from the stabilization circuit 23.

In the light source inverter 2, one ends of primary coils L1*a* and L1*b* in the transformers 21*a* and 21*b* are connected to the switching circuit 24*a*; one ends of primary coils L1*c* and L1*d* in the transformers 21*c* and 21*d* are connected to the switching circuit 24*b*. The other ends of these primary coils L1*a* to L1*d* are grounded. One end of the CCFL 1*a* is connected to one end of the secondary coil L2*a* in the transformer 21*a*, and the rectifier circuit 22*a* is connected to the other end of the secondary coil L2*a*; one end of the CCFL 1*b* is connected to one end of the secondary coil L2*b* in the transformer 21*b*, and the other end of the secondary coil L2*b* is grounded. One end of the CCFL 1*d* is connected to one end of the secondary coil L2*d* in the transformer 21*d*, and the rectifier circuit 22*b* is connected to the other end of the secondary coil L2*d*; one end of the CCFL 1*c* is connected to one end of the secondary coil L2*c* in the transformer 21*c*, and the other end of the secondary coil L2*c* is grounded.

The other ends of the CCFLs 1*a* and 1*b* are connected together, and thus the secondary coil L2*b*, the CCFL 1*b*, the CCFL 1*a*, the secondary coil L2*a* and the rectifier circuit 22*a* are connected in series in turn from the ground side, on the secondary sides of the transformers 21*a* and 21*b*. The other ends of the CCFLs 1*c* and 1*d* are connected together, and thus the secondary coil L2*c*, the CCFL 1*c*, the CCFL 1*d*, the secondary coil L2*d* and the rectifier circuit 22*b* are connected in series in turn from the ground side, on the secondary sides of the transformers 21*c* and 21*d*. The CCFLs 1*a* and 1*d* are so arranged as to interpose the CCFLs 1*b* and 1*c* therebetween.

The operation of the light source device configured as described above will be described below. FIGS. 2A to 2E are timing charts showing the relationship between the input and output of the rectifier circuits 22*a* and 22*b* and the input of the stabilization circuit 23 in the light source device shown in FIG. 1.

Figure 2A:
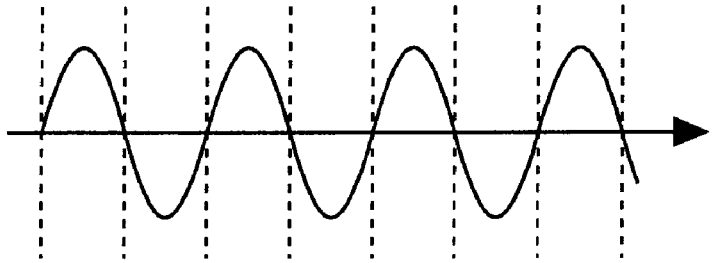
FIGS. 2A to 2E are timing charts showing the relationship between the input and output of rectifier circuits and the input of a stabilization circuit in the light source device shown in FIG. 1.

The switching circuit 24*a* performs the switching operation under the control of the control circuit 25, and thus a desired alternating-current voltage appears across each of the secondary coils L2*a* and L2*b* in the transformers 21*a* and 21*b*. Here, the opposite-phase alternating-current voltage appears across each of the secondary coils L2*a* and L2*b* to allow the CCFLs 1*a* and 1*b* to emit light. Then, the alternating current as shown in FIG. 2A is passed through the rectifier circuit 22*a*. Similarly, the switching circuit 24*b* performs the switching operation under the control of the control circuit 25, and thus a desired alternating-current voltage appears across each of the secondary coils L2*c* and L2*d* in the transformers 21*c* and 21*d*. Here, the opposite-phase alternating-current voltage appears across each of the secondary coils L2*c* and L2*d* to allow the CCFLs 1*c* and 1*d* to emit light. Then, the alternating current as shown in FIG. 2B, which is in opposite phase with the input of the rectifier circuit 22*a*, is passed through the rectifier circuit 22*b*.

Figure 3:
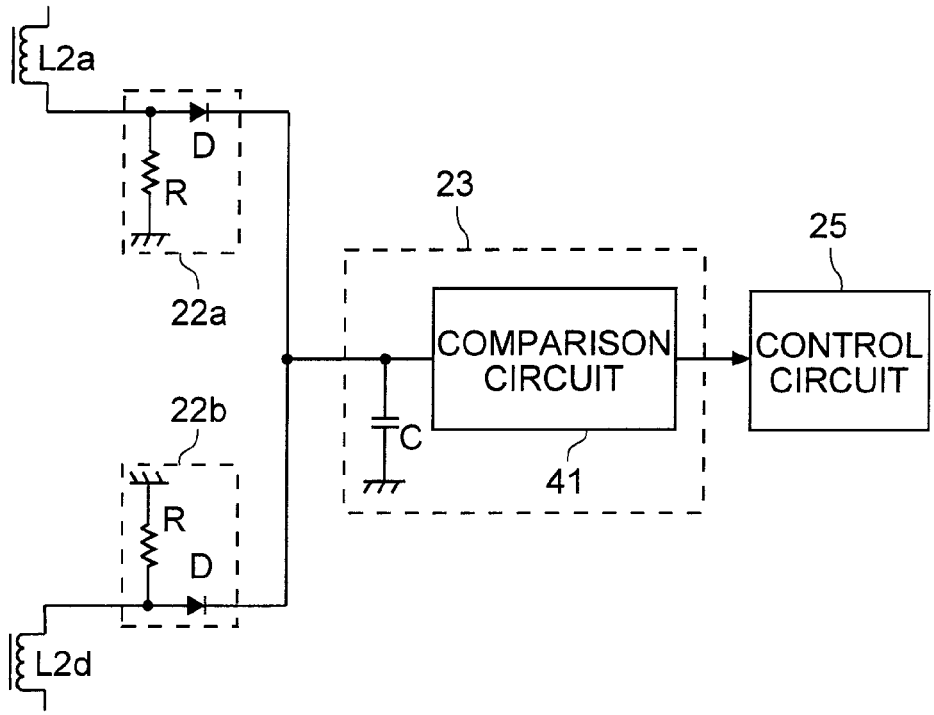
FIG. 3 is a block diagram showing one example of the configuration of the light source device and stabilization circuit shown in FIG. 1.

For example, as shown in FIG. 3, the rectifier circuit 22*a* (22*b*) includes: a resistor R having one end thereof connected to the other end of the secondary coil L2*a* (L2*d*) and the other end thereof grounded; and a diode D having the anode thereof connected to the node between the secondary coil L2*a* (L2*d*) and the resistor R. Thus, the rectifier circuit 22*a* (22*b*) operates as a half-wave rectifier circuit. Specifically, the alternating-current voltage corresponding to the resistance of the resistor R appears based on the alternating current inputted. The diode D allows the only positive component of the alternating-current voltage appearing across the resistor R to pass therethrough. In this way, the half-wave rectification is performed. Although the configuration of the rectifier circuit 22*a* is described by way of example, the rectifier circuit 22*b* is configured in the same way as the rectifier circuit 22*a*, as indicated by the parenthesized reference numerals following the corresponding reference numerals.

Figure 2B:
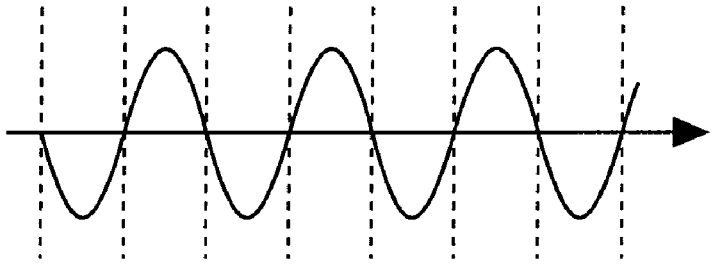
Figure 2C:
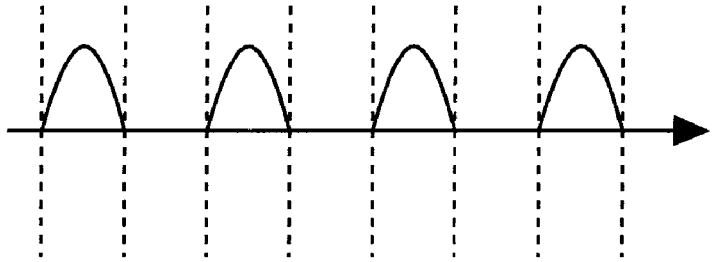
Figure 2D:
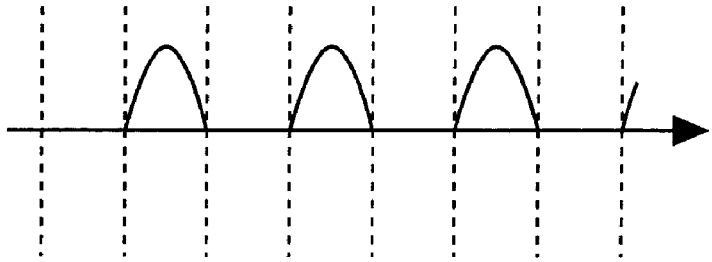

The alternating currents as shown in FIGS. 2A and 2B are half-wave rectified by the rectifier circuits 22*a* and 22*b* after voltage transformation. Thus, the rectifier circuit 22*a* outputs, as shown in FIG. 2C, a voltage signal having the positive component of the waveform shown in FIG. 2A. The rectifier circuit 22*b* outputs, as shown in FIG. 2D, a voltage signal having the positive component of the waveform shown in FIG. 2B; this voltage signal is 180 degrees out of phase with that from the rectifier circuit 22*a* shown in FIG. 2C.

Figure 2E:
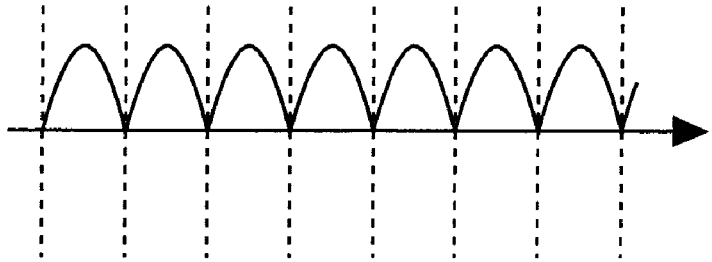

The voltage signals outputted from these rectifier circuits 22*a* and 22*b* are fed to the stabilization circuit 23 as one input signal. Thus, the voltage signal fed to the stabilization circuit 23 is a voltage signal that is obtained by combining the voltage signals, as shown in FIGS. 2C and 2D, from the rectifier circuits 22*a* and 22*b*, that is, a voltage signal, as shown in FIG. 2E, that is full-wave rectified. Specifically, the voltage signals from the rectifier circuits 22*a* and 22*b* are 180 degrees out of phase with each other, and thus voltage signals from the rectifier circuits 22*a* and 22*b* become zero alternately. Hence, the positive components of the voltage signals are fed to the stabilization circuit 23. In other words, the full-wave rectified voltage signal as shown in FIG. 2E is fed to the stabilization circuit 23.

For example, as shown in FIG. 3, the stabilization circuit 23 is provided with: a smoothing circuit including a capacitor C that has one end thereof connected to the cathodes of the diodes D serving as output terminals of the rectifier circuits 22*a* and 22*b* and the other end thereof grounded; and a comparison circuit 41 that compares, with a reference voltage, the voltage appearing across the capacitor C of the smoothing circuit, and that feeds the comparison result to the control circuit 25. The stabilization circuit 23 shown in FIG. 3 smoothes, with the capacitor C in the smoothing circuit, the full-wave rectified voltage signal as shown in FIG. 2E which is obtained by combining the voltage signals, as shown in FIGS. 2C and 2D, from the rectifier circuits 22*a* and 22*b*. This smoothed voltage signal is fed to the comparison circuit 41, which compares this voltage signal with the reference voltage to feed the comparison result to the control signal 25.

The control circuit 25 controls the switching operations of the switching circuits 24*a* and 24*b* according to the comparison result of the comparison circuit 41 included in the stabilization circuit 23. As described above, the control signal fed to the control circuit 25 is a signal that is based on the voltage obtained by smoothing the voltage signal corresponding to the currents (that is, the currents flowing through the CCFLs 1*a* and 1*d*) flowing through the secondary coils L2*a* and L2*d* in the transformers 2*a* and 2*d*. Specifically, the stabilization circuit 23 smoothes the full-wave rectified signal obtained by combing the signals that are generated by the half-wave rectification of the currents flowing through the CCFLs 1*a* and 1*d*. Consequently, the level of the voltage signal fed to the comparison circuit 41 corresponds to the average of the currents flowing through the CCFLs 1*a* and 1*d*.

With the light source device of the configuration of FIG. 1, the operation of the switching circuit 24*a* and 24*b* in the light source inverter 2 is controlled by the operation circuit 25 through the feedback of the average of the currents flowing through the CCFLs 1*a* and 1*d*. Thus, even if the impedances of the CCFLs 1*a* to 1*d* vary due to the uneven thermal distribution within the housing of the backlight in the light source, the currents that are substantially equal to those flowing through the CCFLs 1*a* and 1*d* can be applied irrespective of impedance variations. Thus, it is possible to reduce the influence of impedance variations, and to make more uniform the currents applied to the CCFLs 1*a* to 1*d*.

Figure 4:
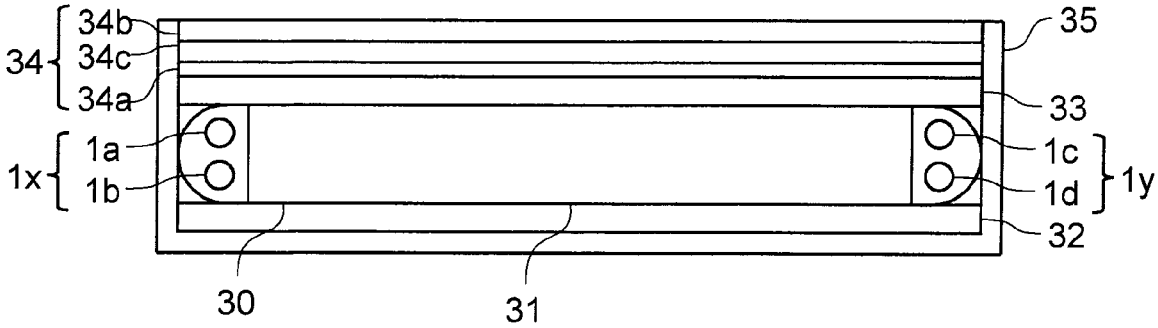
FIG. 4 is a cross-sectional view showing the configuration of an edge-light type transmissive liquid crystal display device employing the light source device of FIG. 1 as a backlight.

The liquid crystal display device incorporating the light source device shown in FIG. 1 as a backlight is configured as shown in the cross section of FIG. 4. A light guide plate 31 is disposed between the substantially U-shaped lamp 1*x* composed of the CCFLs 1*a* and 1*b* and the substantially U-shaped lamp 1*y* composed of the CCFLs 1*c* and 1*d*. In this way, the light from the substantially U-shaped lamps 1*x* and 1*y* arranged on the edges of the light guide plate 31 can be emitted from the surface of the light guide plate 31 in a direction perpendicular to the surface of the light guide plate 31. In this case, the CCFLs 1*a* and 1*b* in the substantially U-shaped lamp 1*x* are arranged side by side in a direction perpendicular to the surface of the light guide plate 31; the CCFLs 1*c* and 1*d* in the substantially U-shaped lamp 1*y* are arranged side by side in a direction perpendicular to the surface of the light guide plate 31.

On the back of the light guide plate 31 is disposed a reflective plate 32 that covers a backlight 30 composed of the light guide plate 31 and the substantially U-shaped lamps 1*x* and 1*y*. On the front of the light guide plate 31, a plurality of optical sheets 33 are first disposed to cover the backlight 30 so as to make uniform the brightness of the light from the backlight 30, and a liquid crystal display panel 34 is then disposed so as to cover the surface of the optical sheets 33. The reflective plate 32, the backlight 30, the optical sheets 33 and the liquid crystal display panel 34 stacked as described above are covered by a housing 35. In this way, the liquid crystal display device is formed. The backlight 30 includes the light guide plate 31; the liquid crystal display device shown in FIG. 4 serves as an edge-light type transmissive liquid crystal display device.

The liquid crystal display panel 34 includes: a thin-film transistor substrate 34*a* in which thin-film transistors are formed in a matrix on a glass substrate by the deposition of transparent semiconductor films such as an ITO (indium tin oxide) film; a color filter substrate 34*b* composed of a plurality of different color filters, such as red, green and blue color filters, which are formed and arranged on the surface of the thin-film transistor substrate 34*a* for the individual pixels; and liquid crystal 34*c* injected between the thin-film transistor substrate 34*a* and the color filter substrate 34*b*.

In the liquid crystal display panel 34 configured as described above, the light from the light guide plate 31 in the backlight 30 and the reflective plate 32 enters the thin-film transistor substrate 34*a*. Here, electric power is supplied to the source and gate terminals of the thin-film transistors for the individual pixels in the thin-film transistor substrate 34*a*, and this allows electric fields to be generated between the thin-film transistors in the thin-film transistor substrate 34*a* and the color filters in the color filter substrate 34*b*. This electric field causes a change in the angle of orientation of the liquid crystal molecules in each pixel, thereby varying the transmittance of the liquid crystal 34*c* in each pixel. In this way, the light having a predetermined brightness level for each pixel is passed through the liquid crystal 34*c* and the color filter substrate 34*b*, with the result that color images are displayed on the liquid crystal display panel 34.

Figure 5:
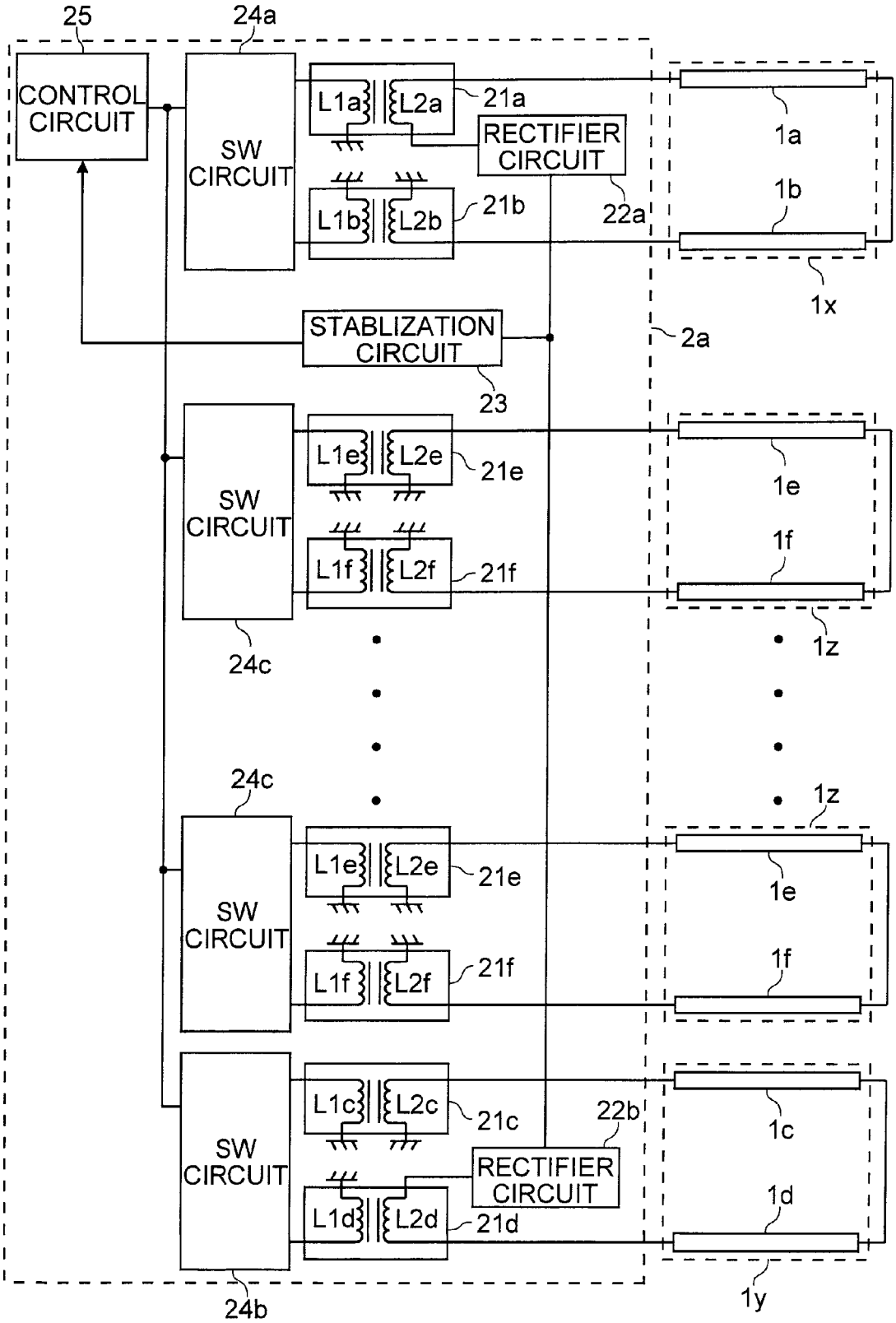
FIG. 5 is a block diagram showing the configuration of a light source device including n substantially U-shaped lamps.

Although the light source device configured as shown in FIG. 1 incorporates two substantially U-shaped lamps 1*x* and 1*y*, three or more substantially U-shaped lamps may be incorporated to practice the present invention. FIG. 5 is a block diagram showing the configuration of a light source device incorporating n substantially U-shaped lamps. In the light source device shown in FIG. 5, such parts as are used for the same purposes as those in the light source device shown in FIG. 1 are identified with common reference numerals, and the detailed description thereof will not be repeated.

The light source device shown in FIG. 5 is provided with: the two substantially U-shaped lamps 1*x* and 1*y* included in the light source device shown in FIG. 1; and (n−2) substantially U-shaped lamps 1*z*. In stead of the light source inverter 2, the light source device shown in FIG. 5 is provided with a light source inverter 2*a* that includes, along with the transformers 21*a* to 21*d*, 2×(n−2) transformers 21*e* and 21*f* connected to 2×(n−2) CCFLs 1*e* and 1*f*, respectively, in the (n−2) substantially U-shaped lamps 1*z*.

In addition to the switching circuit 24*a* controlling the switching of the transformers 21*a* and 21*b* and the switching circuit 24*b* controlling the switching of the transformers 21*c* and 21*d*, the light source inverter 2*a* is provided with: (n−2) switching circuits 24*c* respectively controlling the switching of the (n−2) pairs of the transformers 21*e* and 21*f* for the (n−2) substantially U-shaped lamps 1*z*; the rectifier circuits 22*a* and 22*b*; the stabilization circuit 23; and the control circuit 25. The controls circuit 25 controls the switching of the n switching circuits 24*a* to 24*c* according to the control signal outputted from the stabilization circuit 23.

The primary coils L1*e* and L1*f* in the transformers 21*e* and 21*f* have one ends thereof grounded and the other ends thereof connected to the switching circuit 24*c*. The secondary coil L2*e* in the transformer 21*e* has one end thereof grounded and the other end thereof connected to one end of the CCFL 1*e* in the substantially U-shaped lamp 1*z*. The secondary coil L2*f* in the transformer 21*f* has one end thereof grounded and the other end thereof connected to one end of the CCFL 1*f* in the substantially U-shaped lamp 1*z*. In the substantially U-shaped lamps 1*z*, the other ends of the CCFLs 1*e* and 1*f* are connected together. Thus, on the secondary sides of the transformers 21*e* and 21*f*, the series circuit composed of the secondary coil L2*e* and the CCFL 1*e* is connected in parallel with the series circuit composed of the secondary coil L2*f* and the CCFL 1*f*. The configuration other than the transformers 21*e* and 21*f* and the substantially U-shaped lamps 1*z* is the same as that in FIG. 1.

Figure 11A:
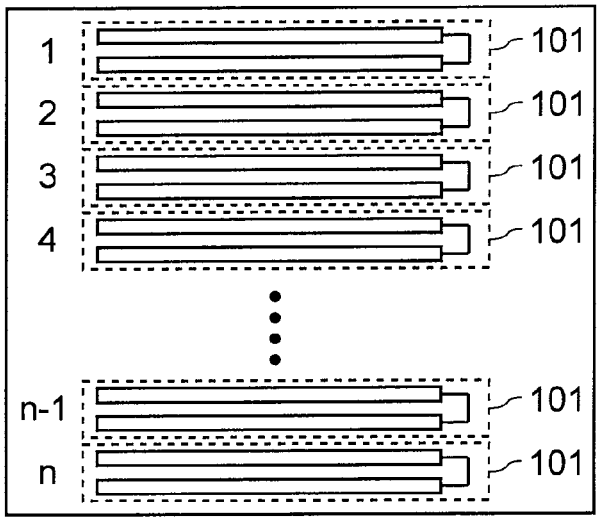
Fig. 11A PRIOR ART
FIG. 11A is a diagram showing an example of how a plurality of substantially U-shaped lamps are arranged.
Figure 11B:
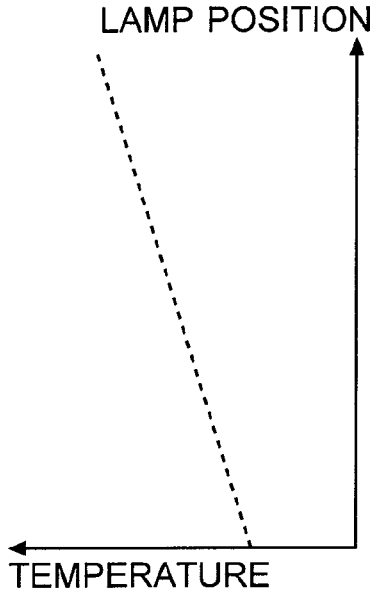
Fig. 11B PRIOR ART
FIG. 11B is a diagram showing thermal distribution in the substantially U-shaped lamps shown in FIG. 11A.

The substantially U-shaped lamps 1*z* are disposed between the substantially U-shaped lamps 1*x* and 1*y*. The CCFL 1*a* in the substantially U-shaped lamp 1*x* and the CCFL 1*d* in the substantially U-shaped lamp 1*y* are disposed at either side of the light source device; the CCFLs 1*a* and 1*d* are so arranged as to interpose the CCFLs 1*b*, 1*c*, 1*e* and 1*f* therebetween. As shown in FIG. 5, the CCFLs 1*a* to 1*f* are arranged in the order of 1*a*, 1*b*, 1*e*, 1*f*, 1*e*, 1*f*, . . . 1*e*, 1*f*, 1*c* and 1*d*. Hence, when heat is distributed within the light source device as shown in FIG. 11B, the CCFL 1*a* disposed in the area where the temperature is the highest and the CCFL 1*d* disposed in the area where the temperature is the lowest are connected to the rectifier circuits 22*a* and 22*b*, respectively.

Hence, the average of the currents through the CCFLs 1*a* and 1*d*, whose impedances are most different from each other, are monitored by the stabilization circuit 23; the control circuit 25 controls the switching operations of the switching circuits 24*a* to 24*c* according to the average of the currents through the CCFLs 1*a* and 1*d*. Thus, since the currents flowing through (2×n) CCFLs 1*a* to 1*f* are controlled to be substantially equal to each other, the amounts of light emitted from the n substantially U-shaped lamps 1*x* to 1*z* are substantially equal to each other.

Figure 6A:
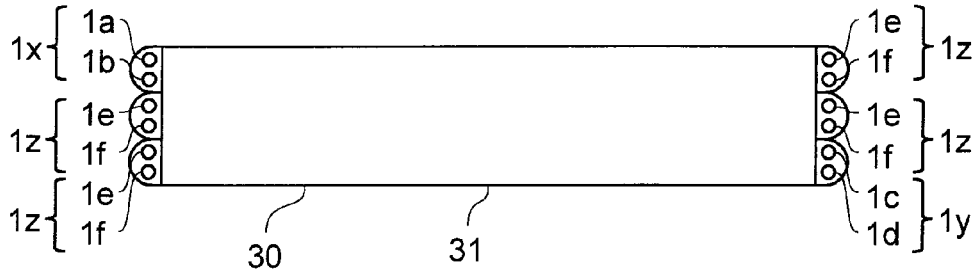
FIG. 6A is a cross-sectional view showing the configuration of an edge-light type transmissive liquid crystal display device employing the light source of FIG. 5 as a backlight.
Figure 6B:
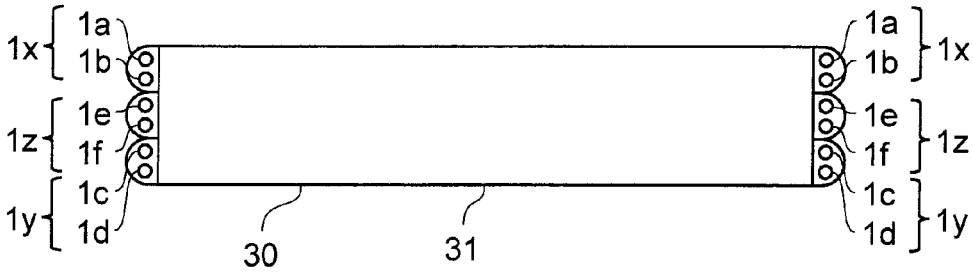
FIG. 6B is a cross-sectional view showing the configuration of an edge-light type transmissive liquid crystal display device employing the light source of FIG. 5 as a backlight.

When the light source device including the n substantially U-shaped lamps 1*x* to 1*z* is used as a backlight, the substantially U-shaped lamps 1*x* and 1*z*, as shown in FIG. 6A, may be arranged on one side of the light guide plate 31 and the substantially U-shaped lamps 1*y* and 1*z* may be arranged on the other side of the light guide plate 31 in the same manner that the backlight shown in FIG. 4 is configured. The substantially U-shaped lamps 1*x* to 1*z* configured as shown in the block diagram of FIG. 5 may be arranged, as shown in FIG. 6B, on each side of the light guide plate 31. The substantially U-shaped lamps configured as shown in the block diagram of FIG. 1 may be arranged on each side of the light guide plate shown in FIG. 6B.

Figure 6C:
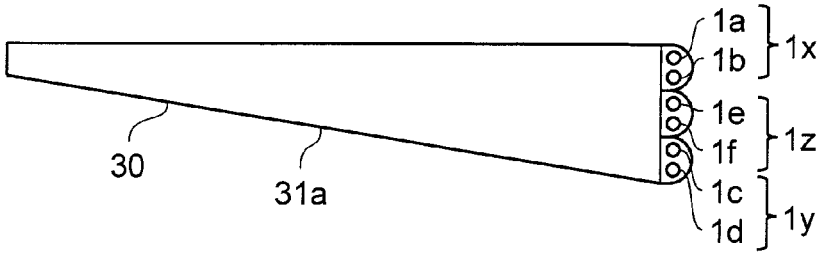
FIG. 6C is a cross-sectional view showing the configuration of an edge-light type transmissive liquid crystal display device employing the light source of FIG. 5 as a backlight.

Although the edge-light type transmissive liquid crystal display devices described above incorporate the backlight that has the substantially U-shaped lamps on both sides of the light guide plate, the substantially U-shaped lamps 1*x* to 1*z* serving as a light source may be arranged, as shown in FIG. 6C, on one end face of a wedge-shaped light guide plate 31*a*. The thickness of the wedge-shaped light guide plate 31*a* in the direction perpendicular to the surface of the light guide plate 31*a* decreases as the light guide plate 31*a* extends away from the end face on which the substantially U-shaped lamps 1*x* to 1*z* are arranged. The substantially U-shaped lamps 1*x* to 1*z* are arranged side by side in a direction perpendicular to the surface of the light guide plate 31*a*. Although the light source devices shown in FIGS. 6A to 6C and configured as shown in the block diagram of FIG. 5 are described by way of example, the wedge-shaped light guide plate 31*a* that has the substantially U-shaped lamps 1*x* and 1*y* serving as a light source on one end face of the light guide plate 31*a* may be likewise used in the light source device configured as shown in the block diagram of FIG. 1.

Figure 7:
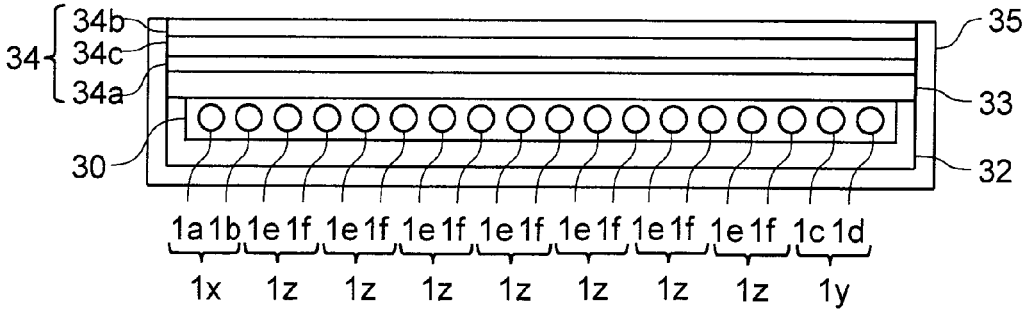
FIG. 7 is a cross-sectional view showing the configuration of a direct-type transmissive liquid crystal display device employing the light source of FIG. 5 as a backlight.

In stead of the edge-light transmissive liquid crystal display device, a direct-type transmissive liquid crystal display device may be used that has a plurality of substantially U-shaped lamps below the optical sheets. When the light source device configured as shown in the block diagram of FIG. 5 is used as a backlight for the direct-type transmissive liquid crystal display device, a plurality of substantially U-shaped lamps 1*z* are arranged, as shown in FIG. 7, between the substantially U-shaped lamps 1*x* and 1*y*. These substantially U-shaped lamps 1*x* to 1*z* are aligned on the surface of the light guide plate 32 covering the inside bottom of the housing 35 so as to emit light from the back of the liquid crystal display panel 34 through the optical sheets 33. The direct-type transmissive liquid crystal display device may incorporate, as a backlight, the light source device configured as shown in the block diagram of FIG. 1.

Figure 8:
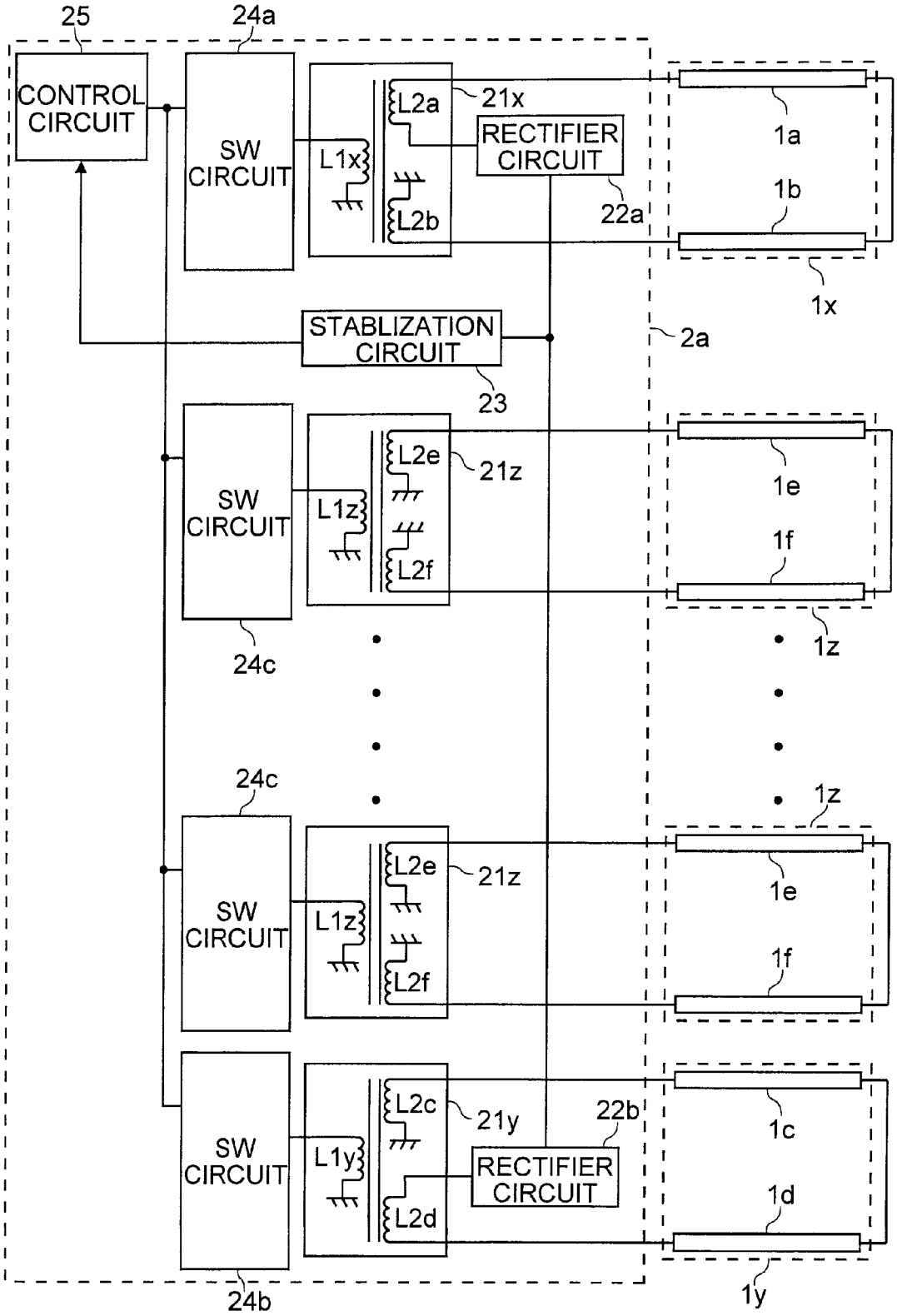
FIG. 8 is a block diagram showing an example of another configuration of the light source device according to the embodiment of the present invention.

Although in this embodiment, each transformer has one primary coil and one secondary coil as shown in FIGS. 1 and 5, each transformer may have one primary coil and two secondary coils as shown in FIG. 8. That is, in the block diagrams shown in FIGS. 1 and 5, a primary coil is provided for the secondary coil connected to each CCFL, and a transformer having one primary coil and one secondary coil is provided for each of CCFLs.

In the case of FIG. 8, there are provided: a primary coil L1*x* engaged in electromagnetic induction with the secondary coils L2*a* and L2*b* connected to the CCFLs 1*a* and 1*b*; a primary coil L1*y* engaged in electromagnetic induction with the secondary coils L2*c* and L2*d* connected to the CCFLs 1*c* and 1*d*; and primary coils L1*z* engaged in electromagnetic induction with the secondary coils L2*e* and L2*f* connected to the CCFLs 1*e* and 1*f*.

That is, in the configuration of FIG. 8, instead of the transformers 21*a* to 21*f* shown in FIG. 5, there are provided: a transformer 21*x* having the primary coil L1*x* and the secondary coils L2*a* and L2*b*; a transformer 21*y* having the primary coil L1*y* and the secondary coils L2*c* and L2*d*; and transformers 21*z* having the primary coils L1*z* and the secondary coils L2*e* and L2*f*. With the configuration of FIG. 8 where each transformer has one primary coil and two secondary coils, it is possible to achieve the same effect as the case where one transformer is provided for each of the substantially U-shaped lamps.

Figure 9A:
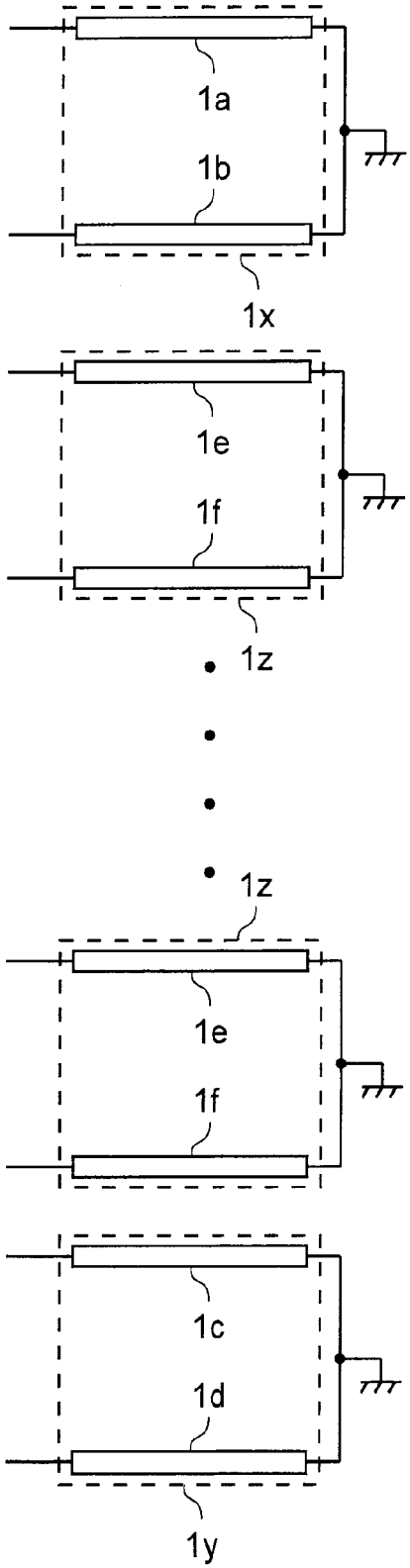
FIG. 9A is a block diagram showing an example of another configuration of substantially U-shaped lamps used in the light source device according to the embodiment of the invention.
Figure 9B:
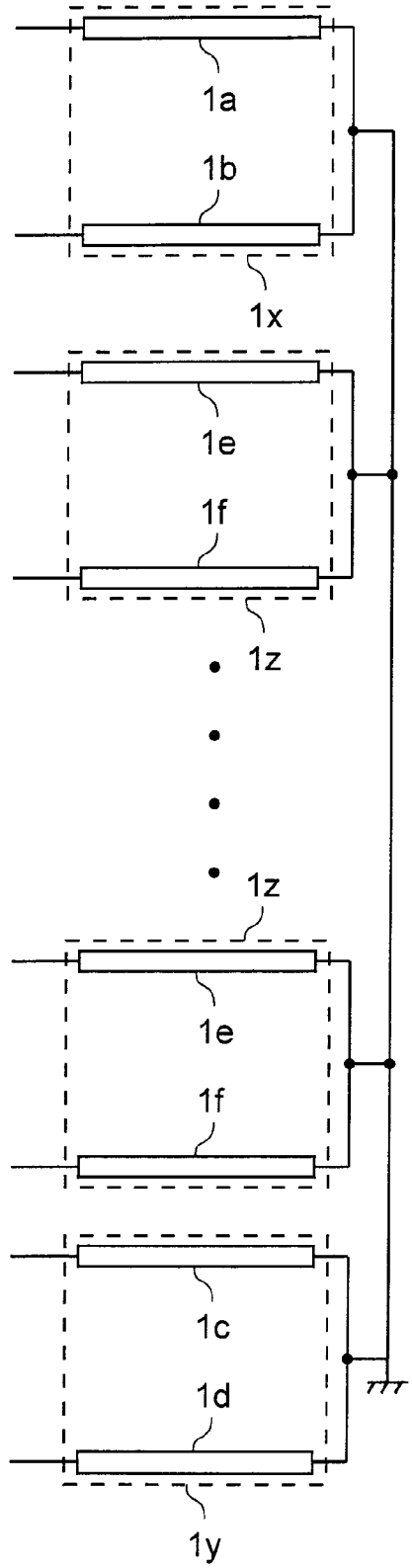
FIG. 9B is a block diagram showing an example of another configuration of substantially U-shaped lamps used in the light source device according to the embodiment of the invention.
Figure 10:
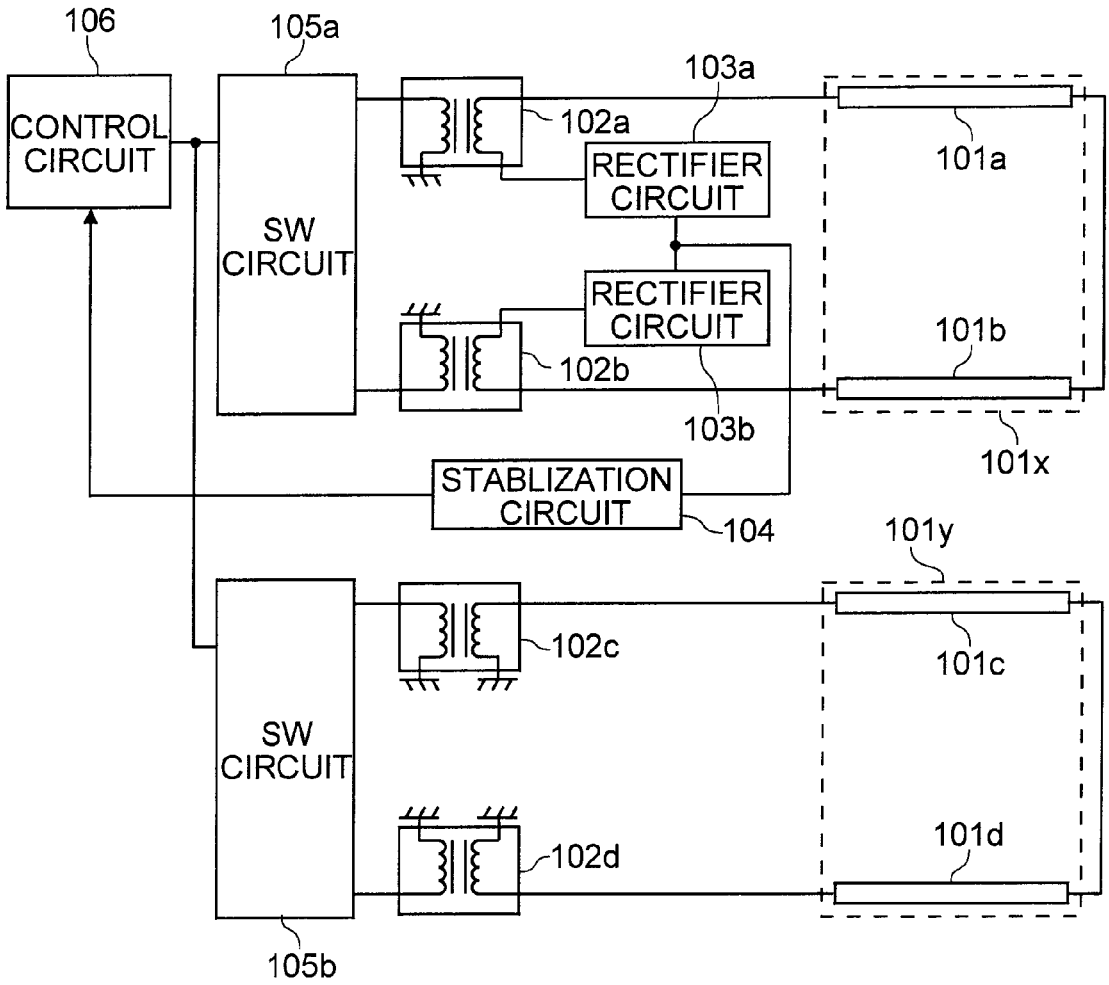
Fig. 10 PRIOR ART
FIG. 10 is a block diagram showing the configuration of a conventional light source inverter.

In the above-described substantially U-shaped lamps 1$x$ to 1$z$, each composed of two CCFLs, the nodes between two CCFLs, that is, the midpoints of the substantially U-shaped lamps 1$x$ to 1$z$ may be individually grounded via separate lines as shown in FIG. 9A; the nodes between two CCFLs, that is, the midpoints of the substantially U-shaped lamps 1$x$ to 1$z$ may be grounded together via a common line as shown in FIG. 9B.

That is, in the case of FIG. 9A, the node between the CCFLs 1$a$ and 1$b$ in the substantially U-shaped lamp 1$x$, the node between the CCFLs 1$c$ and 1$d$ in the substantially U-shaped lamp 1$y$ and the nodes between the CCFLs 1$e$ and 1$f$ in the substantially U-shaped lamps 1$x$ are grounded via the separate lines. In the case of FIG. 9B, the node between the CCFLs 1$a$ and 1$b$ in the substantially U-shaped lamp 1$x$, the node between the CCFLs 1$c$ and 1$d$ in the substantially U-shaped lamp 1$y$ and the nodes between the CCFLs 1$e$ and 1$f$ in the substantially U-shaped lamps 1$x$ are grounded together via the common line.

The present invention can be applied to light source devices incorporating a plurality of lamps as a light source that illuminates displayed portions; such light source devices can be used as direct-type and edge-light type backlights. These backlights can be used as display devices for transmissive liquid crystal display devices and semi-transmissive liquid crystal display devices.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A light source inverter comprising:

power supply sections that are respectively provided to individual ones of a plurality of light-emitting sections, each of the plurality of light-emitting sections including a plurality of light-emitting cathode fluorescent lamps, each of the power supply sections being arranged to independently apply alternating-current voltages to only a corresponding one of the plurality of light-emitting sections;

a control section arranged to control electric power that is applied by the power supply sections to the plurality of light-emitting sections; and a current detection section arranged to detect currents flowing through two separate and independent ones of the plurality of light-emitting sections, to which different power supply sections apply alternating-current voltages, to determine an average of said detected currents, and to generate an output based on said average of said detected currents; wherein the control section controls the electric power applied by the power supply sections to the light-emitting sections based on the currents detected by said output from the current detection section such that the plurality of light-emitting sections are independently controlled on an individual basis.

2. The light source inverter of claim 1, wherein the current detection section comprises:

a first half-wave rectifier circuit arranged to detect and half-wave rectify the current flowing through one of the two light-emitting sections;

a second half-wave rectifier circuit arranged to detect and half-wave rectify the current flowing through the other of the two light-emitting sections; and a stabilization circuit arranged to combine signals from the first and second half-wave rectifier circuits to determine an average of the currents flowing through the two light-emitting sections, and the control section operates based on an output from the stabilization circuit.

3. The light source inverter of claim 1, wherein the light-emitting sections are each a substantially U-shaped light-emitting section composed of two of the light-emitting cathode fluorescent lamps, and the current detection section detects, in each of the two of the light-emitting sections, a current flowing through one of the two light-emitting cathode fluorescent lamps.

4. The light source inverter of claim 3, wherein the current detection section comprises:

a first half-wave rectifier circuit arranged to detect and half-wave rectify the current flowing through one of the two light-emitting sections;

a second half-wave rectifier circuit arranged to detect and half-wave rectify the current flowing through the other of the two light-emitting sections; and a stabilization circuit arranged to combine signals from the first and second half-wave rectifier circuits to determine an average of the currents flowing through the two light-emitting sections, and the control section operates based on an output from the stabilization circuit.

5. A light source device comprising:

the light source inverter of claim 1; and a plurality of light-emitting cathode fluorescent lamps driven by the light source inverter to emit light.

6. The light source device of claim 5, further comprising:

a light guide plate directing the light emitted from the plurality of light-emitting cathode fluorescent lamps in a predetermined direction.

7. A display device comprising:

the light source device of claim 6; and a display section achieving display by receiving light from the light source device.

8. A liquid crystal display panel comprising:

the light source device of claim 6 serving as a backlight; and a liquid crystal panel achieving display by receiving, from behind, light from the light source device, varying orientation of liquid crystal and thus changing a light transmittance of liquid crystal.

9. A display device comprising:

the light source device of claim 5; and a display section achieving display by receiving light from the light source device.

10. A liquid crystal display panel comprising:

the light source device of claim 5 serving as a backlight; and a liquid crystal panel achieving display by receiving, from behind, light from the light source device, varying orientation of liquid crystal and thus changing a light transmittance of liquid crystal.

11. The light source inverter of claim 1, wherein the light-emitting sections are arranged in a line, and the current detection section detects currents flowing through two of the light-emitting sections arranged at both ends of the line.

12. The light source inverter of claim 1, wherein the light-emitting cathode fluorescent lamps included in the light-emitting sections are connected in series, the power supply sections include two transformers each including a coil provided at a secondary side of each respective one of the two transformers, one of the coils of the two transformers is connected to one end of the light-emitting cathode fluorescent lamps connected in series, and the other of the coils of the two transformers is connected to the other end of the light-emitting cathode fluorescent lamps connected in series.

* * * * *